US006318110B1

(12) United States Patent
Katayama

(10) Patent No.: US 6,318,110 B1
(45) Date of Patent: Nov. 20, 2001

(54) ARTIFICIAL SNOW SYSTEM WITH AIR ROOF

(75) Inventor: Minoru Katayama, Hiroshima (JP)

(73) Assignee: Kabushiki Kaisha Piste Snow Industries (JP)

( * ) Notice: Subject to any disclaimer, the term of this patent is extended or adjusted under 35 U.S.C. 154(b) by 0 days.

(21) Appl. No.: 09/487,374

(22) Filed: Jan. 18, 2000

(51) Int. Cl.[7] ..... F25C 3/04
(52) U.S. Cl. ..... 62/347; 52/2.11; 454/188
(58) Field of Search ..... 52/2.11, 63, 222, 52/273; 62/347, 74; 454/188, 189

(56) References Cited

U.S. PATENT DOCUMENTS

| | | | | |
|---|---|---|---|---|
| 1,505,914 | * | 8/1924 | Witteborg | 454/189 |
| 3,860,236 | * | 1/1975 | Buchanan | 454/188 |
| 4,055,112 | * | 10/1977 | Larkfeldt | 454/188 |
| 4,140,105 | | 2/1979 | Duvlis | 128/1 R |
| 4,467,619 | | 8/1984 | Kovach | 62/235 |
| 5,011,152 | * | 4/1991 | Hugunin | 454/188 |
| 5,230,218 | * | 7/1993 | Clulow | 62/74 |
| 5,303,516 | * | 4/1994 | Delamare | 52/2.11 |
| 5,331,991 | * | 7/1994 | Nilsson | 52/2.11 |

FOREIGN PATENT DOCUMENTS

| | | |
|---|---|---|
| 2 679 988 A1 | 2/1993 | (FR) . |
| 2 764 052 A1 | 12/1998 | (FR) . |
| 04005380 | 1/1992 | (JP) . |
| 7-239164 | 9/1995 | (JP) . |
| 10015147 | 1/1998 | (JP) . |

* cited by examiner

*Primary Examiner*—William F. Tapolcai
(74) *Attorney, Agent, or Firm*—Knoble & Yoshida, LLC

(57) ABSTRACT

A facility including an inclined plane for sliding for which snow is used, a snow producing apparatus for producing snow from water and supplying the snow to the facility, and an air jet apparatus for forming an air roof by air flow so that the air roof covers space over the facility, are provided. The air roof covers space over the facility for which artificial snow is used, thus making the building of a roof and the like unnecessary and lowering building costs. The inside of the facility is opened to the fresh air by stopping the supply of air for forming the air roof, which makes special equipment for measures against exhaust gas unnecessary.

9 Claims, 6 Drawing Sheets

ARTIFICIAL SNOW SYSTEM WITH AIR ROOF

BACKGROUND OF THE INVENTION

1. Field of the Invention

The present invention relates to an artificial snow system utilized for facilities such as a skiing ground, a snow-boarding ground, and the like for which artificial snow is used.

2. Description of the Related Art

This kind of faculty for which artificial snow is used is generally housed within doors. This is because, for example, the outside air temperature is often high in regions where artificial snow needs to be used, which requires that the inside of the system is maintained at or below a given temperature to thereby prevent melting of snow.

The above system has, however, a disadvantage that building costs for a roof and the like are very high.

Further, in the above system, a snow spreader and the like are used during maintenance, thereby causing another disadvantage that special equipment for eliminating exhaust gas emitted from the snow spreader is required since the system is within doors.

SUMMARY OF THE INVENTION

An object of the present invention is to provide an artificial snow system capable of lowering building costs.

Another object of the present invention is to provide an artificial snow system which does not need special equipment for measures against exhaust gas.

To attain the above objects, the main aspect of the present invention is a system comprising a facility for which snow is used, snow producing means for producing snow from water and supplying the snow to the facility, and means for forming an air roof by air flow so that the air roof covers space over the facility.

In the present invention, the air roof covers space over the facility for which artificial snow is used, thus making the building of a roof and the like unnecessary and lowering building costs. Further, in the present invention, the inside of the facility is opened to the fresh air by stopping the supply of air for forming the air roof, thus making special equipment for measures against exhaust gas unnecessary.

These objects and still other objects and advantages of the present invention will become apparent upon reading the following specification when taken in conjunction with the accompanying drawings.

DETAILED DESCRIPTION OF THE PREFERRED EMBODIMENT

Figure 1:
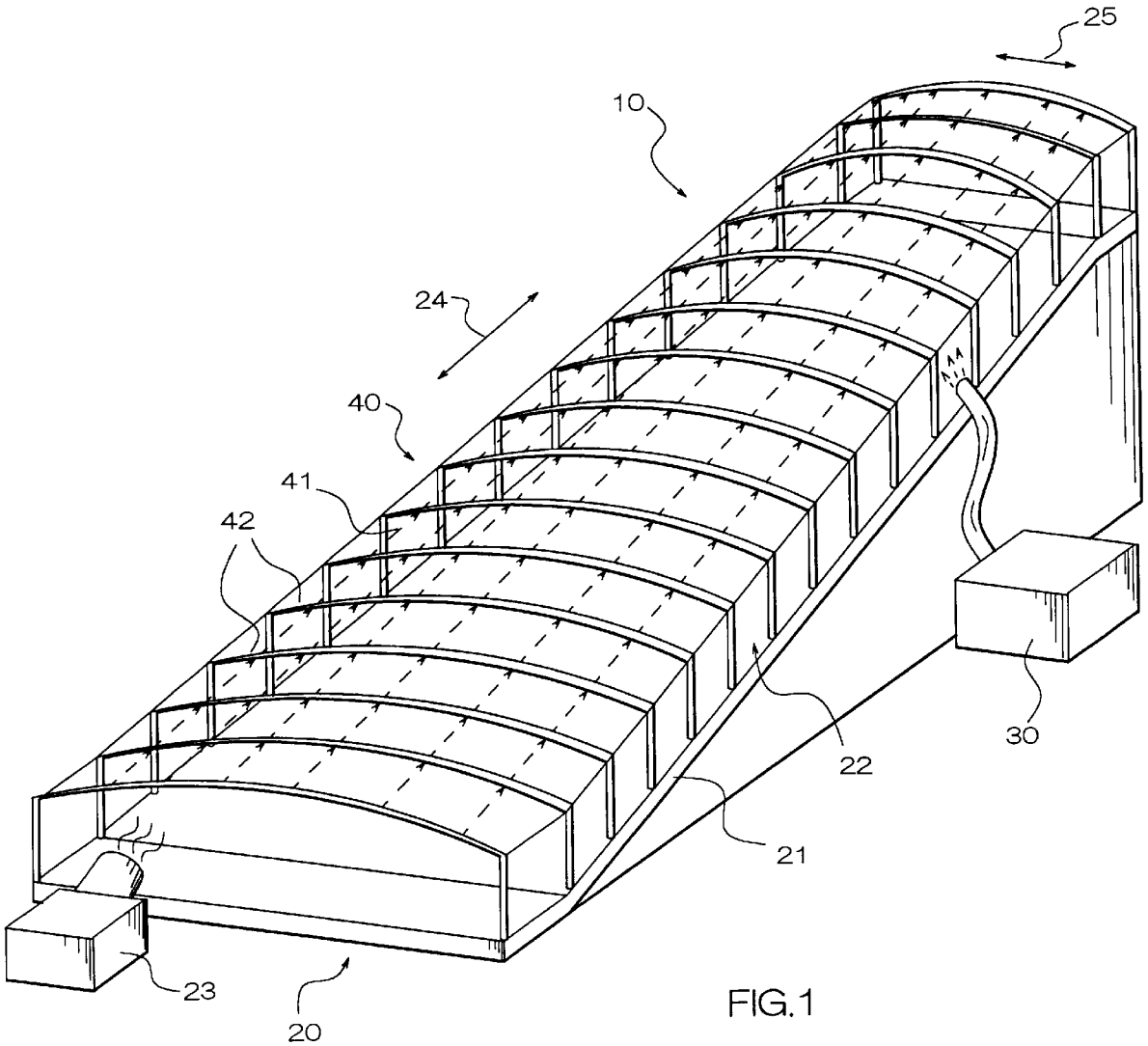
FIG. 1 is a perspective view showing the structure of an artificial snow system according to an embodiment of the present invention.

FIG. 1 is a perspective view showing the structure of a system of an embodiment in which the present invention is applied to a skiing ground or a snow-boarding ground for which artificial snow is used.

An artificial snow system 10 includes a facility 20 for which snow is used, an ICS (Ice Crashing System) 30 for producing snow from water and supplying the snow to the facility 20, and an air roof forming section 40 for forming an air roof 41 by air flow so that the air roof covers space over the facility 20.

Figure 2:
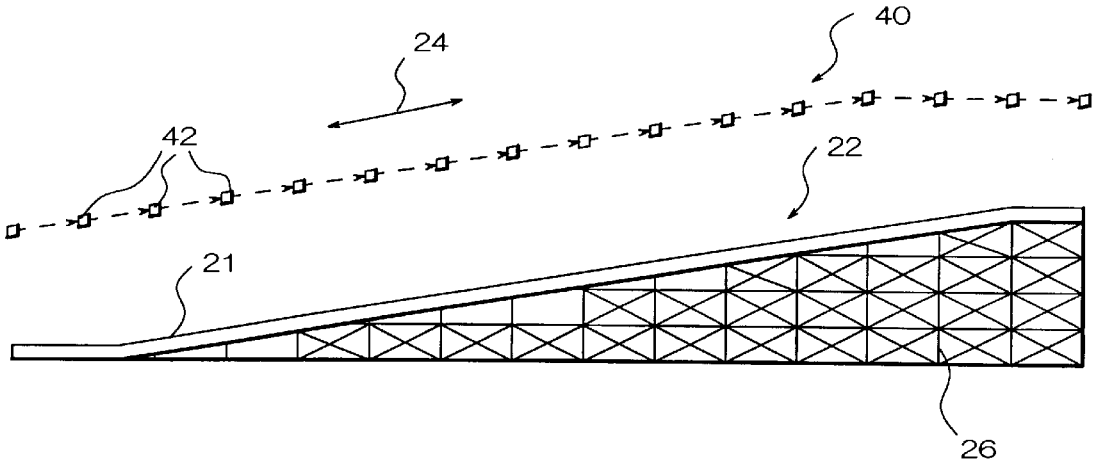
FIG. 2 is a front view of the artificial snow system shown in FIG. 1.

The facility 20 has an inclined portion 21 on which a snow surface, for example, a sliding surface is formed with snow supplied by the ICS 30. As shown in FIG. 2, the inclined portion 21 is held, for example, by a steel construction 26, and has a height of about 15 m to about 100 m at the top thereof, a length of about 100 m to about 500 m, and an inclination of not more than 15°. The facility 20 is provided with an air conditioner 23 for maintaining the inside of a space 22 formed between the inclined portion 21 and the air roof 41 at not more than a predetermined temperature, for example, at a temperature of not more than 15° C.

As shown in FIG. 1 and FIG. 2, the air roof forming section 40 has a plurality of air jet apparatus 42 disposed, for example, at intervals of about 7 m to about 10 m in an inclined direction 24 of the inclined portion 21. The air jet apparatus 42 are disposed at positions higher than the inclined portion 21 by about 10 m, for example.

As shown in FIG. 1, each of the air jet apparatus 42 is disposed across the inclined portion 21 along a direction 25 nearly perpendicular to the inclined direction 24 of the inclined portion 21 above the inclined portion 21. It is preferable that each air jet apparatus 42 is formed into an upward convex shape above the inclined portion 21. This is because there seems to be a wide space over the inclined portion 21 when the inclined portion 21 is seen from the top of the inclined portion 21.

Figure 3:
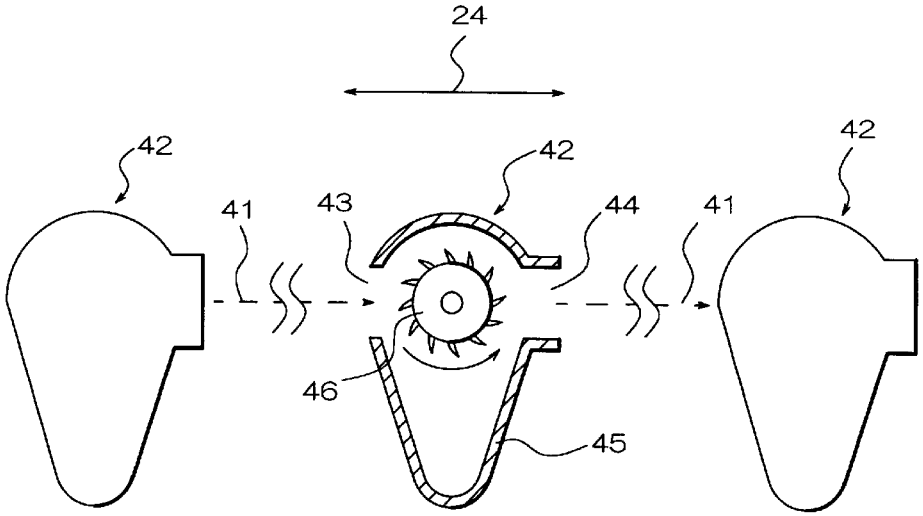
FIG. 3 is a front view showing the structure of an air jet apparatus shown in FIG. 1 and FIG. 2.
Figure 4:
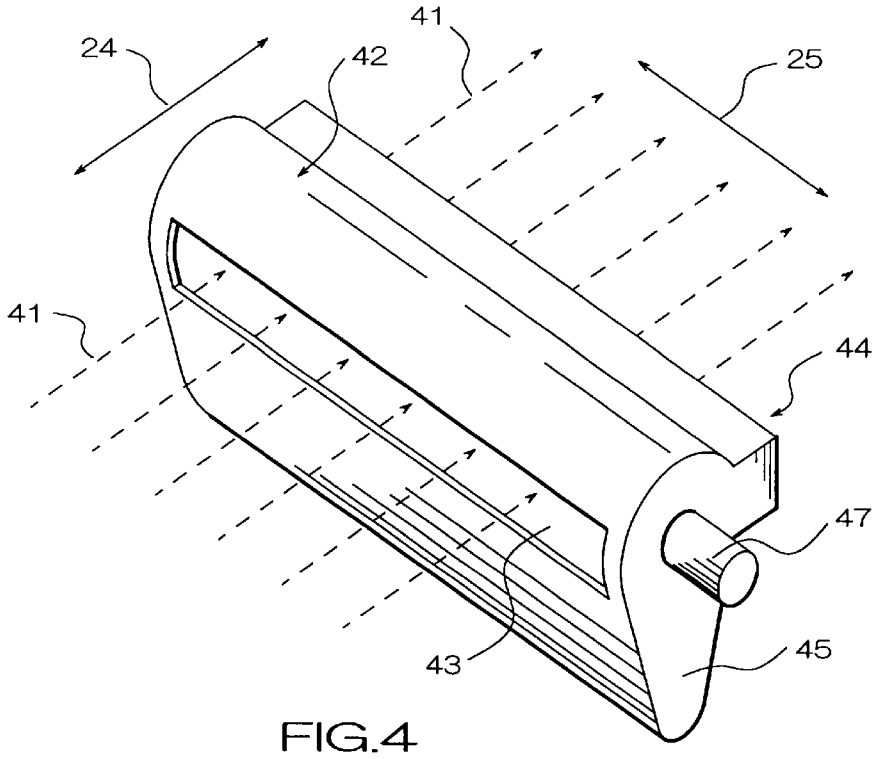
FIG. 4 is a perspective view of the air jet apparatus shown in FIG. 3.

As shown in FIG. 3 and FIG. 4, each air jet apparatus 42 has a long body 45 provided with an inlet port 43 for drawing in air from one side of the inclined direction 24 and a jet port 44 for jetting air to the other side of the inclined direction along the aforesaid direction 25. A cylindrical fan 46 is disposed inside the body 45 and rotated by a motor 47 arranged on one side of the body 45. With the rotation, air is drawn in from the inlet port 43, and jetted from the jet port 44.

Therefore, each air jet apparatus 42 draws in air jetted from the jet port 44 of the air jet apparatus 42 adjacent thereto through the inlet port 43, and jets the drawn air from the jet port 44. Thus, in the air roof forming section 40, the air roof 41 by air flow between the adjacent air jet apparatus 42 is formed so as to cover space over the facility 20. In terms of maintenance of uniform temperature inside the space 22 formed between the inclined portion 21 and the air roof 41, it is preferable that air flow is formed from the lower side to the upper side of the inclined portion 21, but it is naturally suitable that air flow is formed from the upper side to the lower side of the inclined portion 21.

In the system 10 according to this embodiment, space over the inclined portion 21 on which the snow surface is formed is covered with the air roof 41, whereby the space 22 formed between the inclined portion 21 and the air roof 41 can be treated similarly to an indoor space. Meanwhile, as compared with a case where the indoor space is formed, it is unnecessary to build a roof and the like, thereby lowering building costs. When maintenance by the use of a snow spreader or the like is required, the air roof 41 is removed by stopping a jet of air from each air jet port 44, and the space over the inclined portion 21 is opened to the fresh air. As a result, special equipment for measures against exhaust gas becomes unnecessary.

Figure 5:
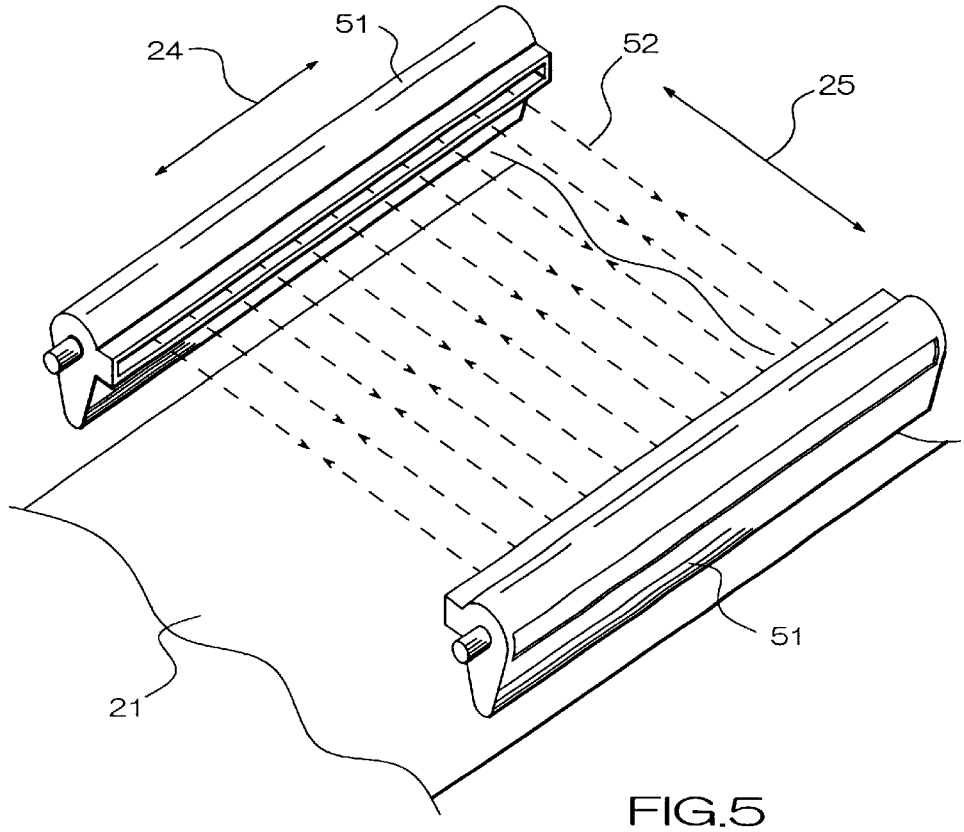
FIG. 5 is a perspective view showing the structure of an air jet apparatus according to another embodiment.
Figure 6:
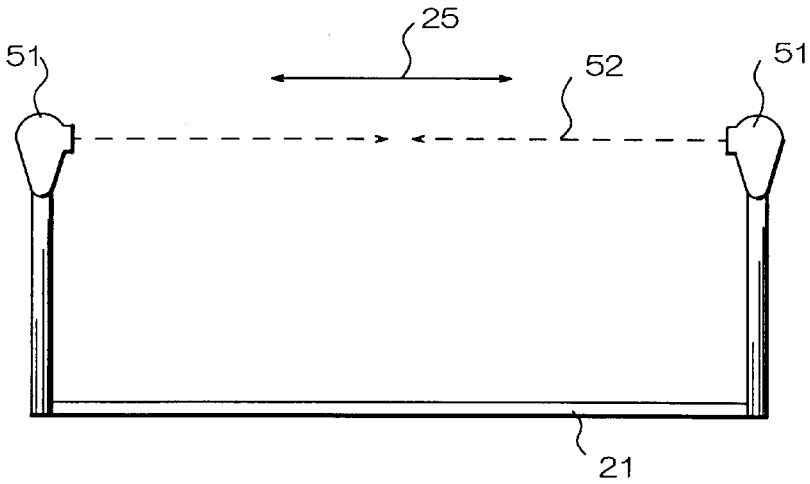
FIG. 6 is a side view showing the structure of the air jet apparatus shown in FIG. 5.

Although the air roof 41 is formed by air flow along the inclined direction 24 of the inclined portion 21 in the aforesaid embodiment, air jet apparatus 51 each for jetting air toward the inclined portion 21 in the direction 25 nearly perpendicular to the inclined direction 24 of the inclined portion 21 to thereby form an air roof 52 may be disposed along both sides of the inclined portion 21 as shown in FIG. 5 and FIG. 6, for example. Consequently, there is nothing over the inclined portion 21, which makes it possible to obtain visually beautiful appearance and further to lower building costs.

Figure 7:
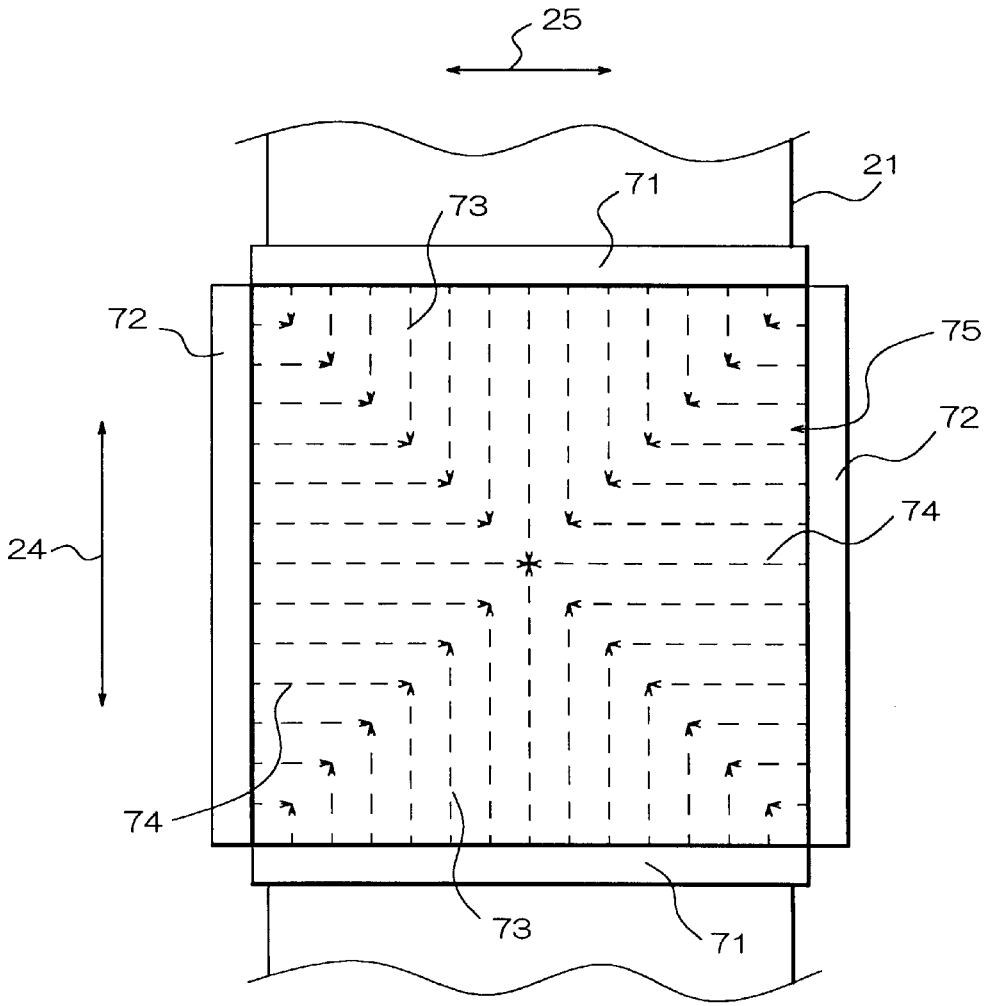
FIG. 7 is a plan view showing the structure of an air jet apparatus according to still another embodiment.
Figure 8:
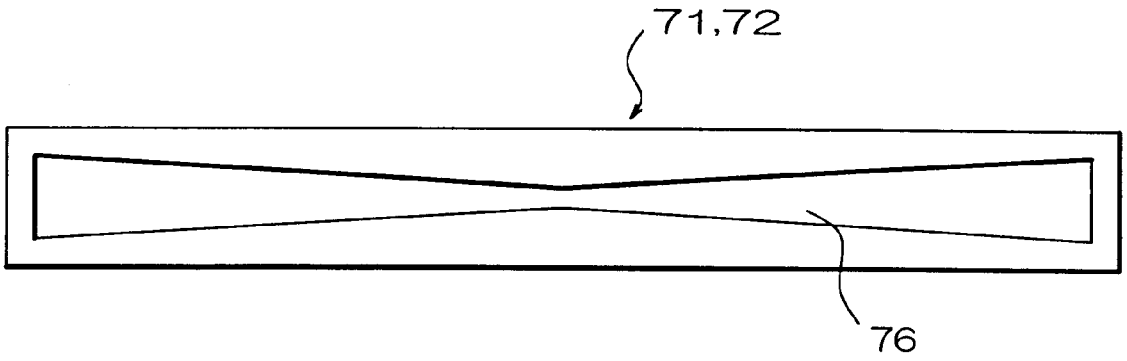
FIG. 8 is a front view of the air jet apparatus shown in FIG. 7.

As shown in FIG. 7, it is suitable that first air jet apparatus 71 for jetting air 73 in the inclined direction 24 are disposed along the direction 25 nearly perpendicular to the inclined direction 24 of the inclined portion 21 above the inclined portion 21, second air jet apparatus 72 for jetting air 74 in such a manner that the air 74 and the air 73 jetted from the first air jet apparatus intersect each other are disposed along both sides of the inclined portion 21, and that wind pressures of the air 73 and the air 74 jetted from the first and the second air jet apparatus 71 and 72 are controlled according to the jet position of air so that wind pressure at the air roof 75 formed by the air 73 and the air 74 jetted from the first and the second air jet apparatus 71 and 72 is almost uniform. For example, the wind pressures of the air 73 and the air 74 jetted from the first and the second air jet apparatus 71 and 72 increase as the jet position gets closer to the center. As a method of controlling the wind pressures of the air 73 and the air 74 jetted from the air jet apparatus 71 and 72 according to the jet position of air, for example, there is a method in which the size of an opening of an air jet port 76 in each of the air jet apparatus 71 and 72 is changed depending on the jet position of air as shown in FIG. 8. When the wind pressure needs to be increased as the jet position approaches the center, for example, the size of the opening of the air jet port 76 needs to be reduced as the jet position gets closer to the center.

Figure 9:
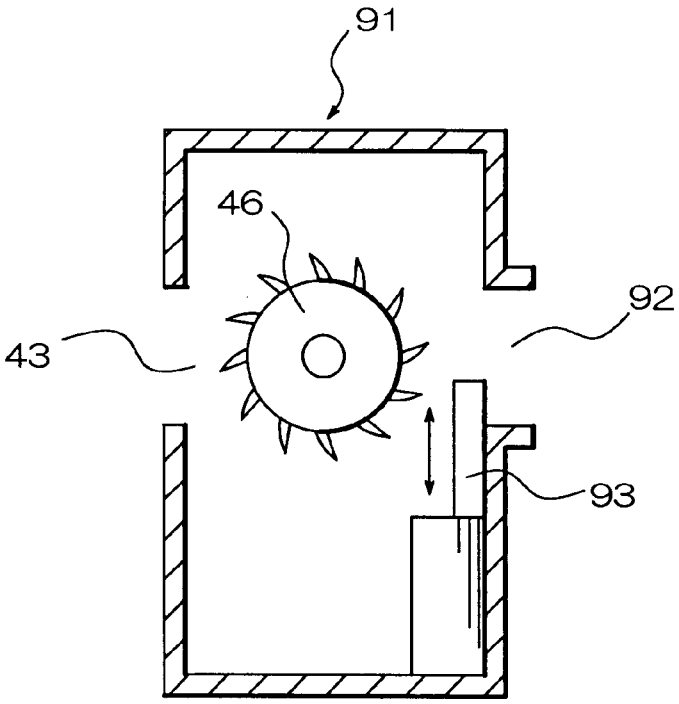
FIG. 9 is a sectional view of an air jet apparatus according to yet another embodiment.

A shutter mechanism 93 for controlling the size of the opening of a jet port 92 of an air jet apparatus 91 is provided as shown in FIG. 9, thereby enabling the control of wind pressure of air jetted from the air jet apparatus 91. For example, the space 22 can be formed more efficiently by controlling the aforesaid wind pressure according to the difference between the temperature of the space 22 formed between the inclined portion 21 and the air roof 41 and outside air temperature. For instance, the wind pressure needs to be decreased when the aforesaid temperature difference is small, while the wind pressure needs to be increased when the temperature difference is large.

Figure 10:
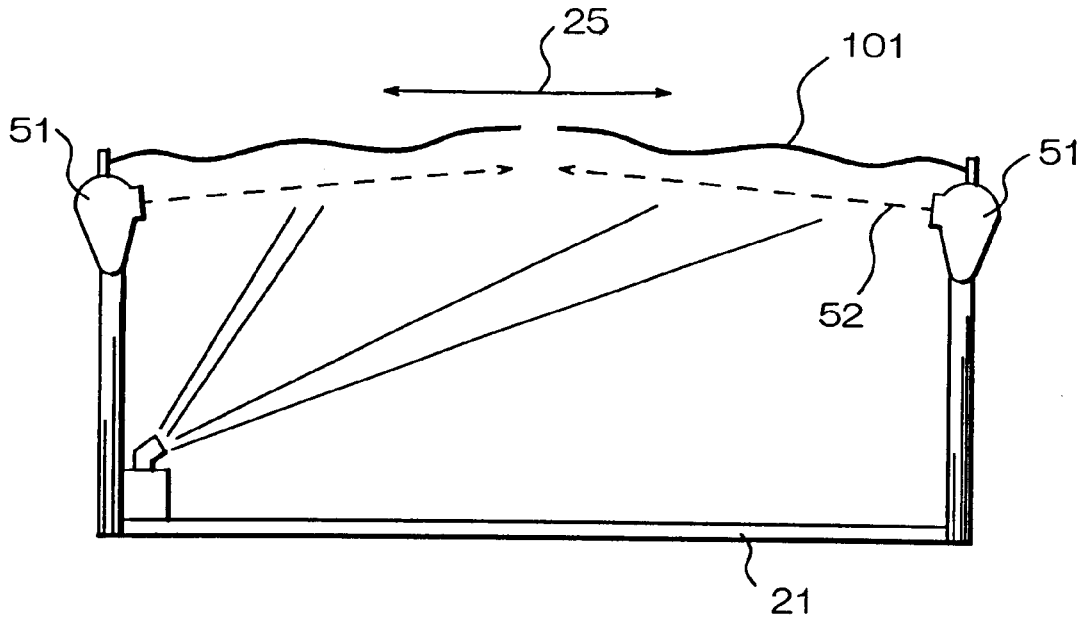
FIG. 10 is a side view showing the structure (the first structure) of an artificial snow system according to still another embodiment.
Figure 11:
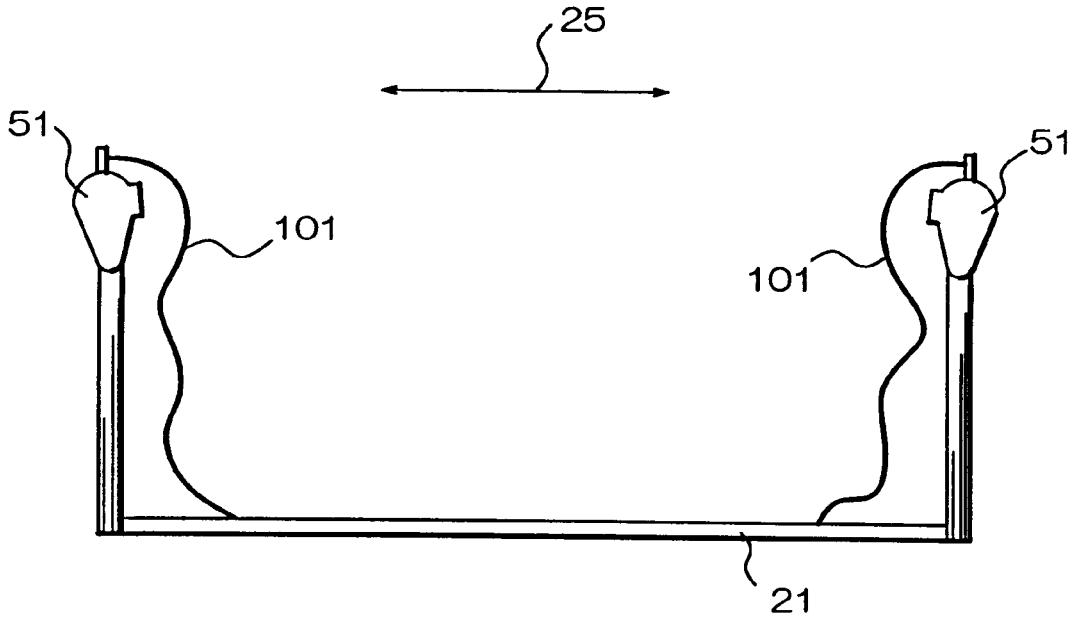
FIG. 11 is a side view showing the structure (the second structure) of the artificial snow system shown in FIG. 10.

As shown in FIG. 10, a flexible roof 101 held by the air roof 52 may be disposed on the air roof 52 (See FIG. 5 and FIG. 6). The flexible roof 101 is made of vinyl, for example, and fixed on the top of each air jet apparatus 51. The above flexible roof 101 functions, for example, as an umbrella, thereby preventing rain from directly falling to the inclined portion 21. Further, light can be irradiated from the inclined portion 21 toward the flexible roof 101 by lighting equipment 102, thus making it possible to create a fantastic space by lighting. Furthermore, the flexible roof 101 can be easily removed, for example, by removing (getting rid of) the air roof 52 depending on outside air temperature. As a result, when the temperature of the inclined portion 21 is not very different from outside air temperature, an opener space can be created. The use of a member which infrared rays do not penetrate for the flexible roof or a coat of paint over the flexible roof can prevent the inclined portion 21 from being exposed to infrared rays.

The present invention can be applied to other facilities for which artificial snow is used as well as an artificial skiing ground and an artificial snow-boarding ground.

The aforesaid embodiment has the intention of clarifying technical meaning of the present invention. Therefore, the present invention is not intended to be limited to the above concrete embodiment and to be interpreted in a narrow sense, and various changes may be made therein without departing from the spirit of the present invention and within the meaning of the claims.

What is claimed is:

1. A system, comprising:

a facility having an inclined surface;

snow producing means for producing snow from water and supplying the snow to said inclined surface; and an air roof forming unit located near said inclined surface for jetting air flow to form an air roof so that the air roof covers over at least said inclined surface at an angle that is substantially parallel to said inclined surface.

2. The system as set forth in claim 1, wherein said air roof forming unit further comprises a plurality of air jet units which are disposed at a predetermined interval in an inclined direction, each of said air jet units jetting air in a direction substantially perpendicular to the inclined direction of the inclined portion above the inclined portion, said air jet units drawing in air from one side of the inclined direction and jetting air to the other side of the inclined direction.

3. The system as set forth in claim 2, wherein said air jet units draw in air from a lower side of the inclined direction and jet the air to an upper side of the inclined direction.

4. The system as set forth in claim 1, wherein said air roof forming unit further comprises air jet units disposed along a side portion of the inclined portion for jetting air toward a center of the inclined portion in a direction that is substantially perpendicular to an inclined direction of the inclined portion.

5. The system as set forth in claim 1, wherein said air roof forming unit further comprises a first air jet unit disposed along a direction nearly perpendicular to an inclined direction of the inclined portion above the inclined portion for jetting first air in the inclined direction;

a second air jet unit disposed along a side portion of the inclined portion for jetting second air in such a manner that the first air and the second air intersect each other; and a wind pressure controlling unit for controlling a relative wind pressure within the first air and the second air according to a relative position so that the wind pressure at the air roof formed by the first air and the second air is uniform.

6. The system as set forth in claim 1, further comprising:

a temperature controlling unit for controlling the temperature of a space between the inclined portion and the air roof.

7. The system as set forth in claim 1, further comprising:

a flexible roof disposed on the air roof and held by the air roof.

8. The system as set forth in claim 7, further comprising:

an air roof determination unit for determining whether or not the air roof is formed by said air roof forming unit according to an outside air temperature.

9. The system as set forth in claim 7, further comprising:

means for irradiating light toward said flexible roof.

* * * * *